United States Patent [19]

Child et al.

[11] 4,209,472

[45] Jun. 24, 1980

[54] FUEL SUPPLY SYSTEM

[75] Inventors: Francis W. Child, Eagle Bend; Richard O. Bartz, Edina, both of Minn.

[73] Assignee: Child Laboratories Inc., Eagle Bend, Minn.

[21] Appl. No.: 736,709

[22] Filed: Oct. 29, 1976

[51] Int. Cl.[2] ..... F02M 29/04

[52] U.S. Cl. ..... 261/23 A; 261/DIG. 56; 261/DIG. 78; 261/DIG. 48; 123/141

[58] Field of Search ..... 123/141, 198 E, 119 EE; 261/DIG. 48, DIG. 56, 23 A, 44 B, 44 C

[56] References Cited

U.S. PATENT DOCUMENTS

| | | | |
|---|---|---|---|
| 2,791,994 | 5/1957 | Gieb | 123/119 EE |
| 2,907,648 | 10/1959 | Chapman | 261/DIG. 48 |
| 3,086,758 | 4/1963 | Greene | 261/44 B |
| 3,768,787 | 10/1973 | Marsee | 261/23 A |
| 3,804,329 | 4/1974 | Martner | 261/DIG. 48 X |
| 3,965,221 | 6/1976 | Englert et al. | 261/DIG. 56 X |
| 4,034,025 | 7/1977 | Martner | 261/DIG. 48 X |
| 4,038,348 | 7/1977 | Kompanek | 261/DIG. 48 X |
| 4,044,077 | 8/1977 | Gupta | 261/DIG. 48 |

FOREIGN PATENT DOCUMENTS

| | | | |
|---|---|---|---|
| 2318779 | 4/1973 | Fed. Rep. of Germany | 261/DIG. 48 |

*Primary Examiner*—Ira S. Lazarus

*Attorney, Agent, or Firm*—Burd, Bartz & Gutenkauf

[57] ABSTRACT

An apparatus for supplying aerosol fuel particles uniformly mixed with air to utilizer, as an internal combustion engine or burner. The apparatus has several fuel mixing and atomizing nozzles operable to mix one or more liquid hydrocarbon fuels and discharge the fuels through orifices in small fuel particles of uniform size. The fuel particles are mixed with air and flow through a pair of venturi throats with converging inlet walls and diverging outlet walls. The velocity of the air and fuel particles flowing through the venturi throats is at or above the speed of sound. The fuel particles are finely divided into particles between 0.5 and 1.5 micron in diameter as they move through the turbulent inlet and outlet interfaces of the air flowing through the nozzle throats at sonic and supersonic velocities and are evenly distributed into the air. The length or major dimension of one of the venturi throats is regulated with a baffle in accordance with the speed requirements of the engine.

24 Claims, 7 Drawing Figures

FUEL SUPPLY SYSTEM

BACKGROUND OF INVENTION

Emissions from conventional internal combustion gasoline engines are formed when hydrocarbon fuel, as gasoline, is burned incompletely into hydrocarbon (HC) and carbon oxides (CO). The formation of pollutant CO, HC and nitrous oxide ($NO_x$) is a function of the proportional amounts of air and fuel introduced into the combustion chamber. The effect of the air-to-fuel ratio on the exhaust combustion of these pollutants is shown in the graph of FIG. 1. Lean air-to-fuel ratios have decreased CO and HC emissions because of the greater quantity of oxygen available for combustion. When the air-to-fuel ratio becomes too lean (below 14:1), both HC and CO emissions increase.

$NO_x$ emissions are an exponential function of flame temperature. At low temperatures, nitrogen and oxygen will not unite to form any significant amount of $NO_x$. Low temperatures are achieved at both rich and lean air-to-fuel ratios because of the dilutant effect exerted by unburned fuel in the rich case and the excess of air in the lean case.

When the internal combustion engine operates at its stiochiometric point, the amount of fuel is matched exactly with the amount of oxygen for complete combustion. This point falls somewhere between 14.5 and 15 pounds of air per pound of fuel. The operation of an engine at this point produces the maximum amount of $NO_x$. An air-to-fuel mixture of 18–20 pounds of air per pound of fuel will produce the least CO, HC and $NO_x$ emissions.

Internal combustion engines will operate effectively at air-to-fuel ratios of 18:1 or even leaner ratios. The operation of the engine under these conditions is contingent on getting the right air-to-fuel mixture into all of the cylinders. With present carburetor technology, the air-to-fuel ratio of the fuel mixture to all of the cylinders is not constant. Some of the cylinders will be fed properly while others will be too lean. Others may be too rich. In either circumstance, there will be an increase in emissions.

Hydrocarbon fuels have a small percentage of foreign liquids and particulate matter, as water, oils, non-combustible carbon, and dirt. These foreign products cause dirt build-up in the carburetor and inefficient fuel-to-air ratios.

Hydrocarbon fuel vapor and air mixing devices have been developed. These devices have structures for heating or elevating the temperature of the fuel prior to the release to the intake manifold of the engine. Examples of fuel vaporizing and air mixing devices are shown in U.S. Pat. Nos. 3,509,859; 3,847,128 and 3,872,848.

High frequency ultrasonic generators having piezoelectric ceramic crystals have been used for ultrasonic cleaning operations and in the material testing field. Other applications include medical and chemical uses for emulsifying and dissolving purposes. Examples of high frequency ultrasonic generators are shown by Scarpa in U.S. Pat. No. 3,433,161 and Rodudo et al in U.S. Pat. No. 3,904,347.

A monodisperse aerosol generator is disclosed by Berglund and Liu in U.S. Pat. No. 3,790,079. This generator has an ultrasonic vibrator that acts on a disc having a discharge orifice. The liquid moving through the orifice is subjected to ultrasonic vibrations which break the liquid down to substantially equal size droplets which are discharged into a chamber.

SUMMARY OF THE INVENTION

The invention is broadly directed to an apparatus and method for providing a lean air-to-fuel mixture to a utilizer, as an internal combustion engine or burner, where the fuel is environmentally and economically used to produce output power or heat. The invention is embodied in an apparatus which utilizes a liquid hydrocarbon fuel and converts the liquid fuel into an aerosol that is uniformly mixed with air prior to its consumption by the utilizer. The apparatus has nebulizers or ultrasonic generators that receive hydrocarbon fuel under pressure. The nebulizers have ultrasonic generating means that are operable to mix a number of different hydrocarbon fuels with each other and with other substances, as water, oils, dirt, and carbon. The nebulizers also discharge the hydrocarbon fuel in small and substantially uniform particles. The fuel particles are moved with incoming air through a sonic nozzle. The sonic nozzle has a pair of converging and diverging throats. One of the throats is an idle throat and the other is a variable size or run throat. The uniform sized liquid fuel particles discharged by the nebulizers are carried by the air stream through the venturi throats. As the air and particles approach the venturi throats, there is a first turbulent inlet interface caused by the rapid acceleration of the air. The air accelerates to a sonic or supersonic speed. A second or outlet interface is experienced as the air and particles leave the venturi throat. The second interface is the result of rapid deceleration of the air to subsonic speeds. As the air and particles move through the acceleration interface and deceleration interface, there is a thorough and rapid breakdown and mixing of the fuel particles with the air. The fuel particles break down into sizes of 1 micron or less in diameter and are evenly distributed with the air. The result is a uniform air-to-fuel ratio which is delivered to the utilizer, such as the combustion chamber of an engine. The fuel and air mixture can also be delivered to the combustion chamber of a burner. The sonic nozzle has a control baffle for regulating the flow of air through the run throat. The baffle is used to increase and decrease the size of the throat in accordance with the desired speed of the engine. A control moves the baffle along the length or major dimension of the throat. The width of the throat is constant. The sonic flow of air through the venturi throats depends upon the upstream pressure and temperature of the air. The amount of vacuum or suction pressure on the outlet side has only a minimal effect on the amount of air and fuel that move through the venturi throats. The quantity of air and fuel moving through the throats is directly proportional to the throat area. The fuel pump for the nebulizers are coordinated with the controls for the baffle so that the fuel dispensed by the nebulizers is in proportion to the size of the venturi throats.

An object of the invention is to provide a fuel supply system for an internal combustion engine or burner that is operable to uniformly mix one or more hydrocarbon fuels and discharge the mixed fuel into substantially uniform, finely divided particles into an air stream. Another object of the invention is to provide a fuel system for an internal combustion engine operable to provide substantially uniform size fuel particles that are evenly distributed in air to form an air-to-fuel ratio that has a minimum of HC, CO and $NO_x$ emissions when burned in an engine. A further object of the invention is to provide a fuel supply system that produces a high air-to-fuel ratio of uniform consistency that burns clean in high compression engines. Yet another object of the invention is to provide a sonic nozzle operable to finely divide liquid hydrocarbon fuel particles into fuel particles having a diameter in the range of 0.5 to 1.5 micron. A still further object of the invention is to provide a fuel system for a utilizer, as an internal combustion engine or burner, that can uniformly mix a number of different fuels into a mixture that is usable in a combustion environment. Yet another object of the invention is to provide a liquid fuel discharge structure with ultrasonic vibration means that mixes liquid fuel with foreign materials and is self cleaning in operation. Another object of the invention is to provide a sonic nozzle with a pair of venturi throats that maintains supersonic air flow conditions over a wide range of engine speeds. These and other objects and advantages of the invention will become apparent from the following detailed description of the fuel supply system.

IN THE DRAWINGS

DESCRIPTION OF PREFERRED EMBODIMENTS

Figure 1:
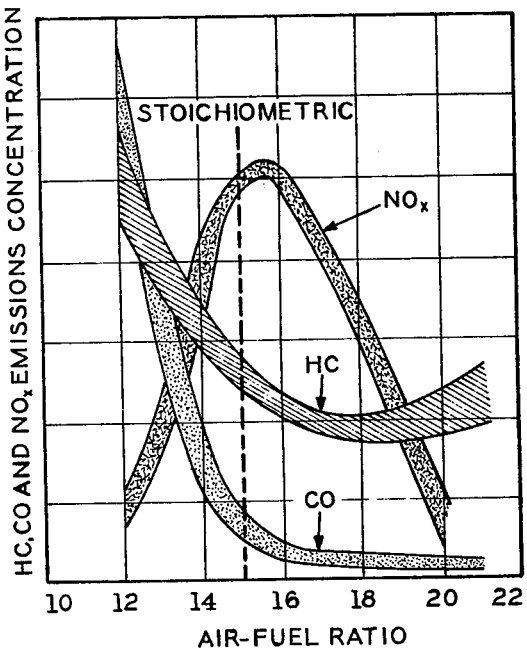
FIG. 1 is a graph showing the relationship between the air-to-fuel ratio and the HC, CO, and $NO_x$ emissions of an internal combustion engine.
Figure 2:
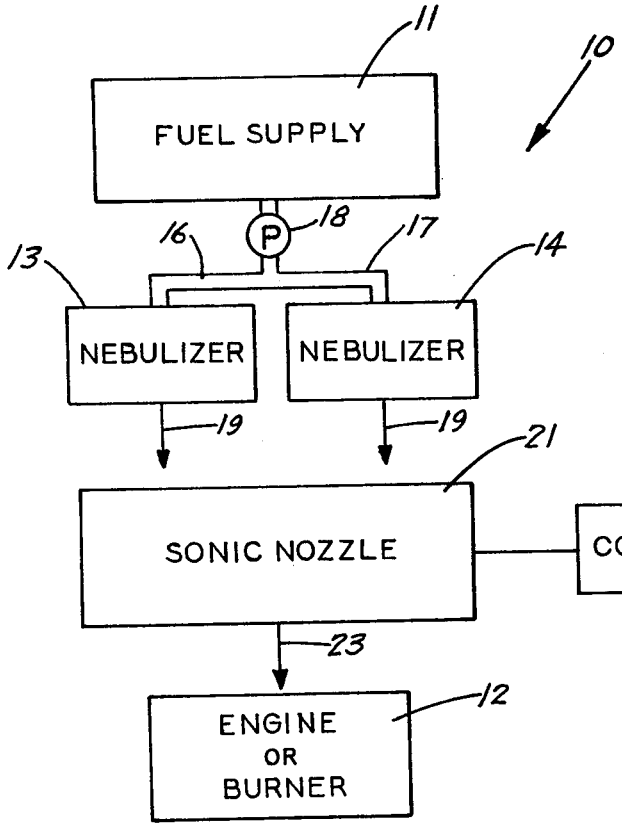
FIG. 2 is a block diagram of the fuel supply system of the invention.

Referring to the drawing, there is shown in FIG. 2 a fuel supply system indicated generally at 10 operable to receive a liquid hydrocarbon fuel, as gasoline, disel fuel, methanol, or the like, from a fuel supply 11 and deliver the liquid fuel as an aerosol appropriately mixed with air to a utilizer 12, as an engine or burner. Preferably, the liquid fuel in aerosol form is mixed with air at a fuel-to-air ratio of about 18:1 so as to produce the least emissions by engine 12. The fuel supply system 10 has a pair of nebulizers or ultrasonic generators 13 and 14 connected to fuel supply 11 with lines 16 and 17. A pump 18 moves the fuel from supply 11 under pressure to the nebulizers. Additional nebulizers as nebulizer 15 shown in FIG. 3, can be used.

Nebulizers 13 and 14 are operable to discharge liquid fuel particles indicated by arrows 19 into a sonic nozzle 21. The nebulizers 13 and 14 function to mix the fuel and discharge the fuel in an aerosol form having a uniform particle size in the range of about 1 micron or less in diameter.

Sonic nozzle 21 is connected to a control 22. Control 22 is operable to regulate the flow of air and fuel particles through the nozzle in a manner such that the air flowing through portions of the nozzle is always at a sonic or supersonic speed. Sonic nozzle 21 has two extremely turbulent interfaces which provide for thorough and uniform mixing of the aerosol fuel with the air. The fuel particles are further reduced in size as they pass through inlet and outlet interfaces. The first interface is when the air and fuel are accelerated from a subsonic to supersonic speed as the air moves through the venturi throats of the nozzle. The second interface is encountered when the air and fuel particles decelerate from a supersonic speed to a subsonic speed. The mixed fuel is then delivered to the engine, as shown by arrow 23.

Figure 3:
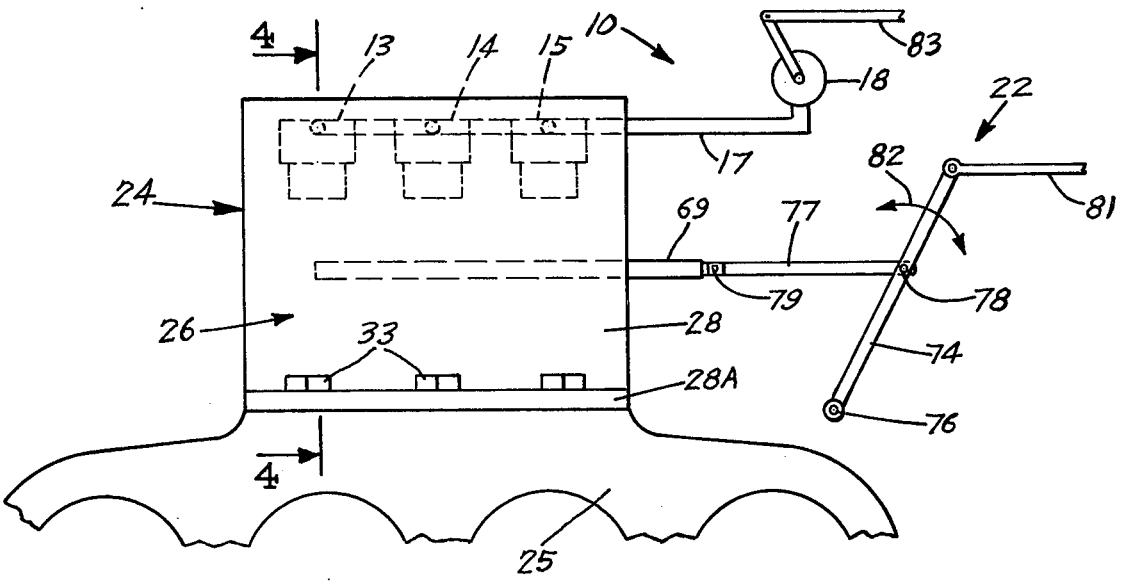
FIG. 3 is a side elevational view of the fuel supply system of the invention mounted on the intake manifold of an internal combustion engine.
Figure 4:
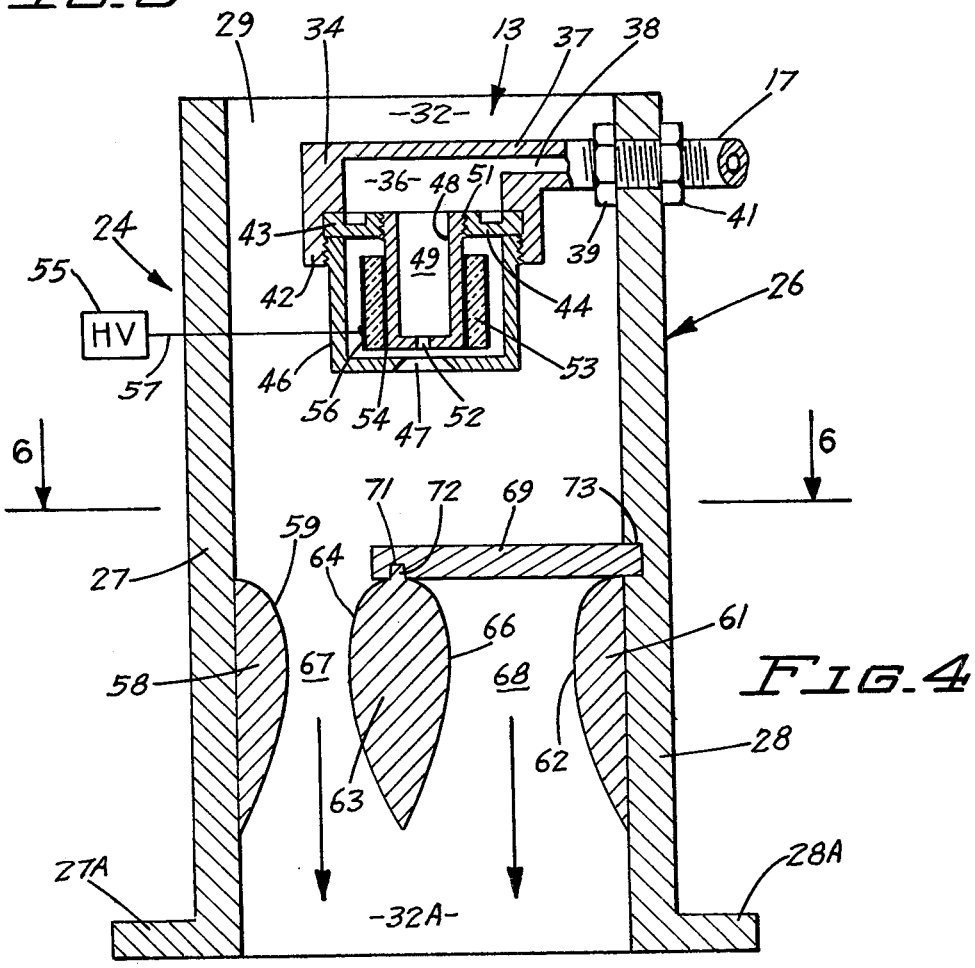
FIG. 4 is an enlarged sectional view of line 4—4 of FIG. 3.
Figure 5:
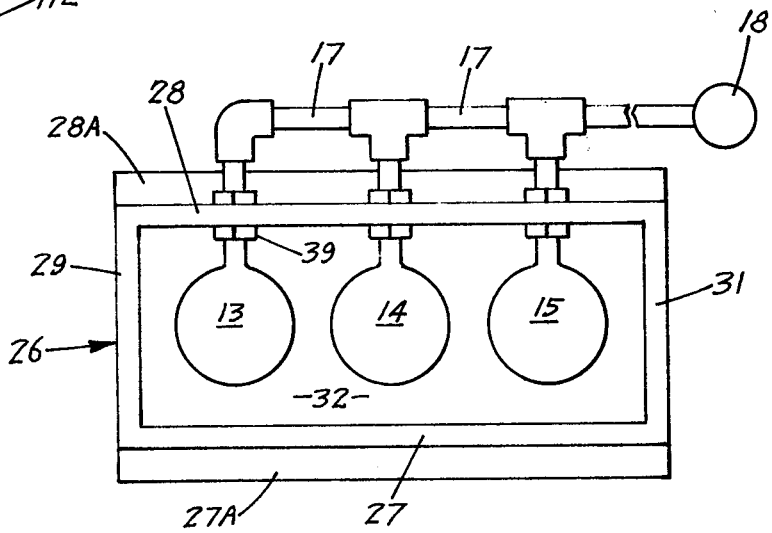
FIG. 5 is a top plan view of FIG. 3.

Referring to FIG. 3, fuel supply system 10 has an air and fuel treatment assembly indicated generally at 24 mounted on an intake manifold 25 of an internal combustion engine. Manifold 25 is illustrated as being connected to four separate cylinders and functions to deliver air and fuel to the cylinders. The number of cylinders of the engine can vary. Assembly 24 can be mounted on a burner. Assembly 24 has a rectangular housing indicated generally at 26. As shown in FIG. 5, housing 26 has elongated parallel side walls 27 and 28 connected to end walls 29 and 31. Walls 27, 28, 29 and 31 form a generally rectangular passage 32 through housing 26. As shown in FIGS. 4 and 5, side walls 27 and 28 have outwardly directed bottom flanges 27A and 28A respectively. Suitable fastening means 33, as bolts, shown in FIG. 3 are used to secure the side walls to manifold 25.

Referring to FIG. 4, nebulizer 13 has a body 34 located in the central portion of passage 32. Body 32 has an internal chamber 36 and a neck 37 attached to the side wall 28. A passage 38 extended through neck 37 is in communication with the fuel line 17. Nuts 39 and 41 threaded on neck 37 secure body 34 to side wall 28. The lower end of body 34 has an annular flange 42 having a recess accommodating a toroidal washer 43. Washer 43 has a thin annular neck or collar 44 to minimize the transfer of the vibrations of the center portion of the washer 43 to body 34. A generally cup-shaped cover or cap 46 is threaded onto body 34 to clamp the washer 43 to body 34. Cover 46 has a bottom with a central opening 47 allowing the fuel particles to be dispensed into passage 32.

Located within cover 46 is a head or cup member 48 having a longitudinal chamber 49. The upper end of chamber 49 is in communication with chamber 36. Member 48 is located in the central opening and threaded on washer 43. The bottom of member 48 has a hole or orifice 52 in longitudinal alignment with hole 47. Member 48 can have additional orifices similar to orifice 52.

A vibrating means 53 surrounds the cup-shaped member 48 and is operable to impart high frequency ultrasonic vibrations to member 48 and the liquid fuel located in chambers 36 and 49. Vibrating means 53 mixes the hydrocarbon fuels with impurities in the fuels. The vibrations or vibratory forces on the liquid fuel also has a self-cleaning effect on member 48 and its orifice 52. The sonic vibrations are at frequencies exceeding a megacycle. Other sonic vibration frequencies can be used to achieve the mixing, breakdown and self-cleaning characteristics caused by vibrating means 53. Vibrating means 53 is a ceramic collar as a tube of piezoelectric ceramic material as, for example, barium titanate zirconate. The collar surrounds the side wall of member 48 and is attached thereto. The ceramic collar has inner and outer electrode coatings or films 54 and 56 aplied to its inner and outer surfaces respectively. Tube 61 is processed and treated to vibrate in a principal resonant thickness mode. The nebulizers or ultrasonic generators 14 and 15 have the same structure as shown by nebulizer 13 in FIG. 4. All of the electrode coatings on the ceramic tubes 53 are connected to a high voltage source 55. Other types of vibrating structures can be used to vibrate member 48 and the liquid fuel.

Sonic nozzle 21 has a first side wall 58 secured to the inside of wall 27 and a second side wall 61 secured to the inside of wall 28. Side wall 28 has a convex curved surface 59. Side wall 61 has a similar inwardly directed convex surface 62. The space between surfaces 59 and 62 is separated with an elongated divider 63. Opposite ends of the divider are secured to the end walls 29 and 31. Divider 63 has a generally tear-shaped cross section with outside convex surfaces 64 and 66. The surface 64 faces surface 59 and is spaced from the surface 59 to form an elongated idler venturi throat 67. The surface 66 is spaced from the convex surface 62 to form a variable size or run venturi throat 68. The throat 68 has about twice the width of throat 67. Throats 67 and 68 have the same length. Other width relationships between the throats 67 and 68 may be used.

The length or major dimension of throat 68 through which air and fuel can flow is regulated with a slide valve or plate 69. The plate 69 is a baffle slidably mounted on side wall 26 and the top of divider 63. The bottom side of plate 69 has an elongated linear groove 71 slidably mounted on an upwardly directed rib 72 on the top of divider 63. Wall 26 has a groove 73 for accommodating an edge of plate 67. The plate 69 extends through a suitable hole in end wall 63 so that it can be linearly moved to adjust the length of throat 68. Throat 68 has a fixed and uniform width or minor dimension. The length of throat 68 is changed by movement of plate 67 without changing its width.

The control for moving the plate 69 comprises a pivoted lever 74 mounted on a pivot structure 76. The midportion of lever 74 is connected to a link 77 with a pivot 78. The opposite end of link 77 is connected with a pivot structure 79 to plate 69. An actuator 81 is connected to the upper end of lever 74. Actuator 81 is movable to pivot lever 74, as indicated by arrow 82, and thereby move the plate 69 into and out of the housing 26, thereby adjusting the size of the venturi throat 68. Other types of controls can be used to move plate 69.

In use, with the engine idling, plate 69 is moved to its in or closed position, completely closing the venturi throat 68. All of the air and fuel moving through the sonic nozzle 21 moves through the idler throat 67. The air moves through the venturi throat 67 and into the intake manifold and engine. The nebulizers 13, 14 and 15 receive fuel under pressure from the pump 18. The pressurized fuel is discharged through opening 52 into the air moving through passage 32. Vibrating means 53, being subjected to a high voltage power, vibrates the fuel to mix the fuel in chamber and vibrates the orifice 52. The frequency of vibration of the member 48 is in the megacycle range which atomizes the liquid fuel as it is discharged through nozzle 52 in relatively small and uniform fuel particles. Preferably, the particle size is between 0.5 and 1.5 microns in diameter. The atomized fuel is mixed with air in passage 32. As the mixed air and fuel approach the venturi throat 67, the fuel and air pass through an inlet interface at the entrance to the venturi throat. This interface is caused by the rapid acceleration of the air to a sonic and supersonic speed. In the interface area, the fuel particles in the air are thoroughly integrated and reduced in size. The fuel and air pass through the venturi throat 67 and discharged to the lower section 32A of the passage 32. The fuel passes through a second deceleration interface. As soon as the fuel and air leave the venturi throat 67, there is rapid deceleration of the flow of fuel to a subsonic flow. This causes further size reduction and uniform mixing of the air and fuel before it enters the manifold 25.

The speed of the engine is increased by moving the plate 69 to an open position. FIG. 4 shows plate 69 open to aproximately half of full speed, exposing a portion of the venturi throat 68. The size of the venturi throats 67 and 68 are coordinated with the size of the engine, that is, the amount of air required by the engine to operate at various speeds is correlated with the sonic flow of air through the venturi throats 67 and 68. As the air and fuel pass through venturi throat 68, they pass through acceleration and deceleration interfaces to thoroughly mix the particles with the air. The pump 18 has a control 83 which is coordinated with the actuator rod 81 so that the amount of fuel supplied to the nebulizers 13, 14 and 15 is in accordance with the fuel requirements of the air flowing through the venturi throats 67 and 68.

Figure 7:
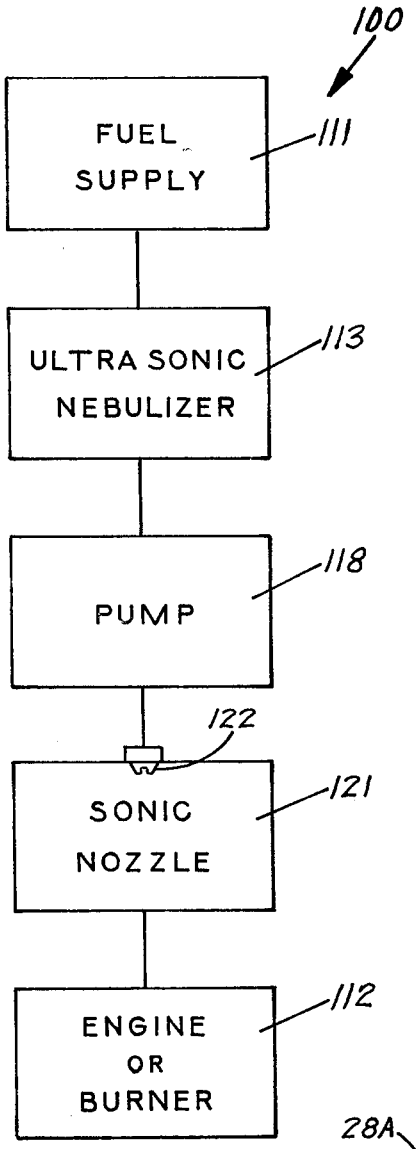
FIG. 7 is a block diagram of a modification of the fuel supply system of the invention.
Figure 6:
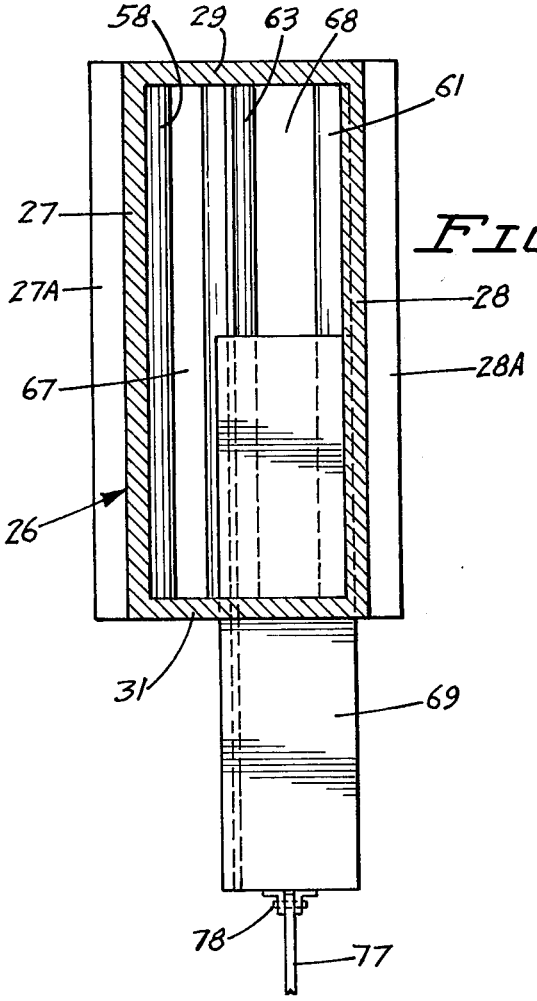
FIG. 6 is a sectional view taken along line 6—6, on a reduced scale.

Referring to FIG. 7, there is shown a modification of the fuel supply system of the invention indicated generally at 100. System 100 has a hydrocarbon fuel supply 111 connected to an ultrasonic nebulizer 113. The fuel is withdrawn from the nebulizer 113 with a pump 118. The pump delivers the fuel to a sonic nozzle 121. A plurality of discharge structures 122 having orifices dispense a spray of fuel to the sonic nozzle 121. The sonic nozzle 121 is mounted on an engine or burner and functions to deliver mixed air and fuel to the utilizer 112. Nebulizer 113 is identical in structure to nebulizer 13 shown in FIG. 4. The sonic nozzle 121 follows the sonic nozzle structure shown in FIGS. 4 and 6.

The fuel supply 111 can be a single hydrocarbon fuel or a number of different hydrocarbon fuels. The plurality of fuels are mixed in the ultrasonic nebulizer. The mixed fuel is delivered to the pump which discharges the mixed fuel into the sonic nozzle. The sonic nozzle breaks the fuel down into atomized form and mixes the fuel with air. The mixture of fuel and air is delivered to the engine or burner.

Several preferred embodiments of the invention have been shown and described. It is understood that various changes and modifications can be made by those skilled in the art without departing from the invention.

The embodiments of the invention in which an exclusive property or privilege is claimed are defined as follows:

1. An apparatus for supplying an air and fuel particle mixture to a means for using the mixture comprising: a housing having a passage adapted to carry an air and fuel particle mixture to the means for using the mixture, first means for introducing particles of fuel into the passage, said particles of fuel being mixed with air in said passage to form an air and fuel particle mixture, and second means mounted on the housing and located in the passage downstream of the first means forming a first venturi throat and a second venturi throat, said first venturi throat being unobstructed and smaller than the second venturi throat, said first and second venturi throats receiving the air and fuel particle mixture and directing the mixture to the means for using the mixture, and control means for controlling the flow of the air and fuel mixture only through said second venturi throat, said first venturi throat remaining open at all times.

2. The apparatus of claim 1 wherein: the second means includes a first side wall secured to the inside of a first portion of the housing, second side wall secured to the inside of the second portion of the housing, said first and second side walls having first and second convex curved surfaces respectively, a divider member located between said first and second side walls, said divider member having third and fourth outside convex surfaces facing the convex surfaces of the first and second side walls, said first convex surface being spaced from the third convex surface to form said first venturi throat, said second convex surface being spaced from the fourth convex surface to form said second venturi throat.

3. The apparatus of claim 2 wherein: the first and second side walls and the divider are elongated, linear members located in parallel relation relative to each other.

4. The apparatus of claim 1 wherein: the first venturi throat has a width smaller than the width of the second venturi throat.

5. The apparatus of claim 1 wherein: the first venturi throat has an elongated first rectangular shape and the second venturi throat has an elongated second rectangular shape.

6. The apparatus of claim 5 wherein: the first rectangular shape has a width smaller than the width of the second rectangular shape.

7. The apparatus of claim 6 wherein: the control means is a movable member operable to change the length of the second rectangular shape of the second venturi throat.

8. The apparatus of claim 1 wherein: the control means comprises a plate movably mounted on the housing for movement generally along the length of said divider member and second side wall.

9. An apparatus for supplying an air and fuel particle mixture to means for using the mixture comprising: housing means having a passage adapted to carry air and fuel mixture to the means for using the mixture, first means for introducing particles of fuel into the passage, said particles of fuel being mixed with air in said passage to form an air and particle mixture, and second means mounted on the housing and located in the passage downstream of the first means forming a first venturi throat and a second venturi throat, said first venturi throat being unobstructed and smaller than the second venturi throat, said second means including a divider member separating said first venturi throat from said second venturi throat whereby said air and fuel particle mixture flow through said first and second venturi throats to the means for using the mixture, and control means located over said second venturi throat for controlling the flow of air and fuel particle mixture only through said second venturi throat, said first venturi throat remaining open at all times for accommodating flow of said air and fuel particle mixture.

10. The apparatus of claim 9 wherein: the first venturi throat and the second venturi throat each have generally rectangular shapes.

11. The apparatus of claim 9 wherein: the second means includes a first wall secured to the inside of a first portion of the housing, a second side wall secured to the inside of the second portion of the housing, said first and second side walls having first and second convex curved surfaces respectively, said divider being located between said first and second side walls, said divider having third and fourth outside convex surfaces facing the convex surfaces of said first and second side walls, said first convex surface being spaced from the third convex surface to form said first venturi throat, said second convex surface being spaced from the fourth convex surface to form the second venturi throat.

12. The apparatus of claim 11 wherein: the first and second side walls and a divider are elongated linear members located in parallel relation relative to each other.

13. The apparatus of claim 11 wherein: the first venturi throat has a width smaller than the width of the second venturi throat.

14. The apparatus of claim 11 wherein: the first venturi throat has an elongated first rectangular shape, and the second venturi throat has an elongated rectangular shape.

15. The apparatus of claim 9 wherein: the control means is a movable member operable to change the length of the second venturi throat.

16. The apparatus of claim 9 wherein: the control means includes a plate movably mounted on the housing and divider for movement generally along the length of the divider to change the length of the second venturi throat.

17. A venturi apparatus for carrying a fluid comprising: a housing having a passage adapted to carry fluid to a desired location, means associated with the housing forming a first venturi throat and a second venturi throat located in the passage for accommodating fluid flowing through said passage, said first venturi throat being unobstructed and smaller than the second venturi throat, and control means for controlling only the flow of fluid through said second venturi throat, said first venturi throat remaining open at all times for accommodating flowing fluid.

18. The apparatus of claim 17 wherein: the first venturi throat and the second venturi throat each have generally rectangular shapes.

19. The apparatus of claim 17 wherein: the means associated with the housing includes a first wall secured to the inside of a first portion of the housing, a second side wall secured to the inside of the second portion of the housing, said first and second side walls having first and second convex curved surfaces respectively, said divider being located between said first and second side walls, said divider having third and fourth outside convex surfaces facing the convex surfaces of said first and second side walls, said first convex surface being spaced from the third convex surface to form said first venturi throat, said second convex surface being spaced from the fourth convex surface to form the second venturi throat.

20. The apparatus of claim 19 wherein: the first and second side walls and a divider are elongated linear members located in parallel relation relative to each other.

21. The apparatus of claim 19 wherein: the first venturi throat has a width smaller than the width of the second venturi throat.

22. The apparatus of claim 19 wherein: the first venturi throat has an elongated first rectangular shape, and the second venturi throat has an elongated rectangular shape.

23. The apparatus of claim 17 wherein: the control means is a movable member operable to change the length of the second venturi throat.

24. The apparatus of claim 17 wherein: the control means includes a plate movably mounted on the housing and divider for movement generally along the length of the divider to change the length of the second venturi throat.

* * * * *